US006367757B1

(12) United States Patent
Aramaki

(10) Patent No.: US 6,367,757 B1
(45) Date of Patent: Apr. 9, 2002

(54) HANGING DEVICE

(75) Inventor: Noriyoshi Aramaki, Kawaguchi (JP)

(73) Assignee: Aramaki Technica Co., Ltd., Saitama (JP)

( * ) Notice: Subject to any disclaimer, the term of this patent is extended or adjusted under 35 U.S.C. 154(b) by 0 days.

(21) Appl. No.: 09/642,933

(22) Filed: Aug. 22, 2000

(30) Foreign Application Priority Data

Aug. 23, 1999 (JP) ..... 11-235700

(51) Int. Cl.[7] ..... A47H 1/10
(52) U.S. Cl. ..... 248/327; 248/332; 248/343
(58) Field of Search ..... 248/342, 343, 248/317, 327, 328, 332

(56) References Cited

U.S. PATENT DOCUMENTS 4,436,335 A * 3/1984 Yoos ..... 248/317 X
5,556,195 A * 9/1996 Glebe ..... 248/328 X
5,725,190 A * 3/1998 Cluthbertson et al. ..... 248/343
6,073,892 A * 6/2000 Dittmer ..... 248/327 X
6,092,777 A * 7/2000 Kuntz ..... 248/343 X

* cited by examiner

*Primary Examiner*—Ramon O. Ramirez
(74) *Attorney, Agent, or Firm*—Lowe Hauptman Gilman & Berner, LLP

(57) ABSTRACT

A hanging device is characterized, by comprising a base frame to be mounted to a ceiling beam, a second frame to be lifted to the base frame, a base body hung from the second frame, a means for lifting up the second frame together with the device body to the base frame through a hole formed to a ceiling board under the ceiling beam, a flange mounted to the device body so as to fit the ceiling board, and a means for engaging the second frame in the base frame at a position in such that the device body is set up to the ceiling board and simultaneously, the flange fits to the under surface to the ceiling board.

5 Claims, 12 Drawing Sheets

HANGING DEVICE

DESCRIPTION OF THIS INVENTION

1) The Technical Field of this Invention

This invention relates to a hanging device adapted to such as an illuminant, sound instrument, air conditioner, etc., attached to a ceiling board.

2) The Prior Arts

Generally, when such an electric device as an illuminant, a sound instrument, an air conditioner should be attached to a high ceiling beam, there is provided with a scaffold assembled on a large scale with a plurality of operators. This matter causes unavoidable cost-up and risk to the operation for setting the device to the ceiling board. Particularly, it is rather difficult to set the device to the inclined portion of the doom-shaped ceiling board.

SUMMARY OF THE INVENTION

A hanging device according to this invention is characterized by comprising a base frame to be mounted to a ceiling beam, a second frame to be lifted to the base frame, a base body hung from the second frame, a means for lifting up the second frame together with the device body to the base frame through a hole formed to a ceiling board under the ceiling beam, a flange mounted to the device body so as to fit the ceiling board, and a means for engaging the second frame in the base frame at a position in such that the device body is set up to the ceiling board and simultaneously, the flange fits to the under surface to the ceiling board.

Accordingly, operations for mounting the base frame to the ceiling beam and lifting the second frame until the second frame engaging to the base frame only accomplish to set the device body to the ceiling board with ease and without the building of the scaffold and risk.

An embodiment of this invention will be detailed in the reference of the description mentioned below with the following drawings.

EMBODIMENTS OF THIS INVENTION

Figure 1:
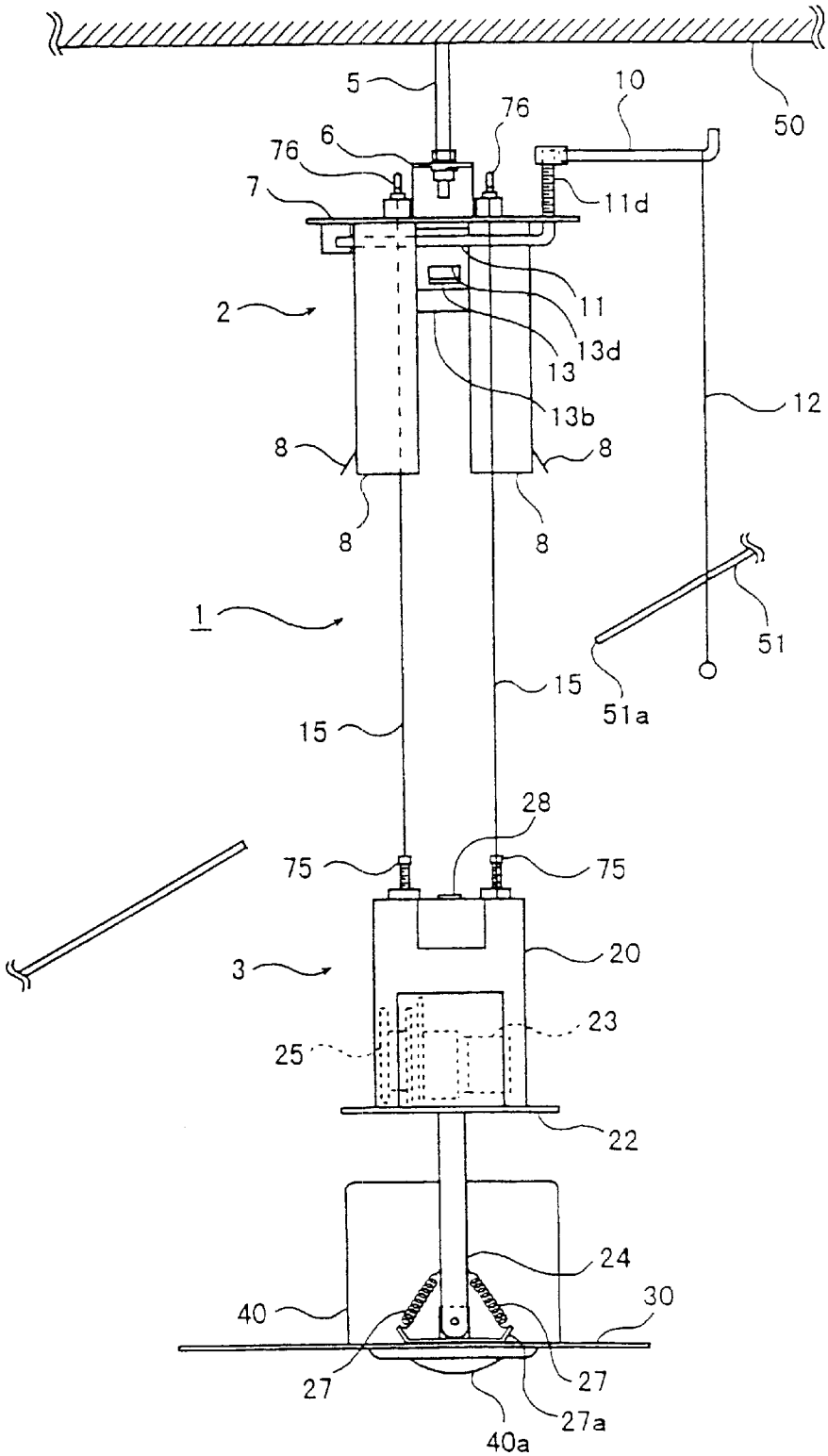
FIG. 1 is a front view of the hanging device of this invention embodied shown in the lifting condition before it being set up.

An embodiment of this invention is illustrated in FIGS. 1 to 14. There is provided with an improved hanging device 1 which comprises a base frame 2 to be mounted to a ceiling beam 50, a second frame 3 to be lifted to the base frame 2, a device body 40 hung from the second frame 3, a means for lifting up the second frame 3 together with the device body 40 to the base frame 2 through a hole 51*a* formed to a ceiling board 51 under the ceiling beam 50, a flange 30 mounted to the device body 40 so as to fit the ceiling board 51, and a means for engaging the second frame 3 to the base frame 2 at a position in such that the device body 40 is set up to the ceiling board 51 and simultaneously, the flange 30 fits to the under surface to the ceiling board 51.

In this embodiment, the base frame 2 includes two supporting rods 5 each the top end of which is rigged with the ceiling beam 50, a frame board 7 shaped into a square and attached to the supporting rods 5 through brackets 6, and a pair of guide members 8 each having a L-shaped horizontal cross section and mounted to the under opposite corner portions of the frame board 7.

The second frame 3 includes a square-shaped shell 20 with a bottom board 22 and corner leaders 70 each having a guide sharp edge 70*a*, and the square-shaped shell 20 can be induced to the area between the guide members 8 when the second frame 3 is lifted up.

The hanging means includes a winch 25 having a drum for winding a hanging wire 15 and a wire stay member 62 for supporting the terminal end of the hanging wire 15. Both the winch 25 and the wire stay member 62 are mounted on the bottom board 22 and the winch 25 is driven by an electric motor 23.

The hanging means further includes a plurality of standing pulleys 61, which guide the hanging wire 15 from the winch drum to the wire stay member 62 or in the reverse order, are mounted to the base frame 2, and the pulleys 61 are rotationally supported to bearing brackets 60 mounted to the frame board 7.

Guide pulleys 63, 64, 66 and 67 are rotationally supported by the shell 20 and a guide roller 65 shaped into a beer barrel is also provided with the second frame 3. When the motor 23 drives the winch 25, in its rotation, the wire 15 is wound around the drum so as to lift up the second frame 3 toward the base frame 2, and in its reverse rotation, is released from the drum so as to lift down the second frame 3.

In this embodiment, the device body 40 is an illumination instrument with its under position having a globe 40*a*, and is hung from the second frame 3 through a hanging member 24 so that the gravity center of the device body 40 is disposed to or near the hanging position pivoted to the hanging member 24. There is provided with means for biasing the device body 40 in a manner to be maintained in its horizontal condition. The biasing means comprises a plurality of tension coiled spring members 27.

Furthermore, the engaging means includes a pair of hanger members 13 each pivoted to the frame board 7 in such a open condition that the second frame 3 can be lifted to an engaging position adapted to the hanger members 13, and a swinging member 11 for operating the hanger members 13 in such a close condition that the second frame 3 is engaged to the hanger members 13.

That is each of the hanger members 13 has an arm 13*a* extending under the swinging member 11 so as to be lifted up by the gravity of the hanger member itself when the swinging member 11 is moved upwards, a guide portion 13*b* bending outside so as to guide a hook member 28 mounted on the shell 20, a hinge axle 13*c* for pivotally supporting the swinging member 11, and a slit 13*d* for engaging the hook member 28. In this embodiment, the hook member 28 has a sharp-knife edge 28*a* to push the guide portion 13*b* when the second frame 3 is lifted up.

The swinging member 11 includes a swinging portion 11*a* horizontally extending under the frame board 7, a branch portion 11*b* in parallel to the swinging portion 11*a* in a manner to position the arms 13*a* between the portions 11*a* and 11*b*, a fulcrum portion 11*c* formed to one end of the swinging portion 11*a* with its supported to a bracket mounted to the under portion of the frame board 7, and a vertical extending portion 11*d* formed to the other end of the swinging portion 11*a* and connected to a bar member 10.

The bar member 10 extends to wards the side of the hanging device and has an operating rope 12 hanging down from its free end. The vertical extending portion 11*d* is biased upwards by means of a spring member, for example, a compression coiled spring member.

In this embodiment, the motor 23 can be energized by an outer source such as an alternating current source or by a battery carried to the second frame 3. The device body 40 can be also energized by an outer source (not shown), via an insulated cable 90 and contact electrodes 75 disposed to the second frame 3 as well as contact electrodes 76 disposed the base frame 2, so as to induce the electric current when the contact electrodes 75 are connected to opposite electrodes 76 due to the lifting up of the second frame.

There is further provided with a switch 80 which is manually operated so as to switch on or off for driving operation of the motor 23, and a limit switch (not shown) automatically operating to its switching off when the second frame 3 is engaged so as to be hung from the base frame 2.

In operation, the base frame 2, at the first, is fixedly attached to the ceiling beam 50 and the necessary electric wiring is disposed to the base frame 2. The second frame 3 is assembled on the floor and the hanging wire 15 is released from the winch drum and turned over the pulleys 61. The terminal end of the wire 15 is attached to the wire stay member 62.

Figure 2:
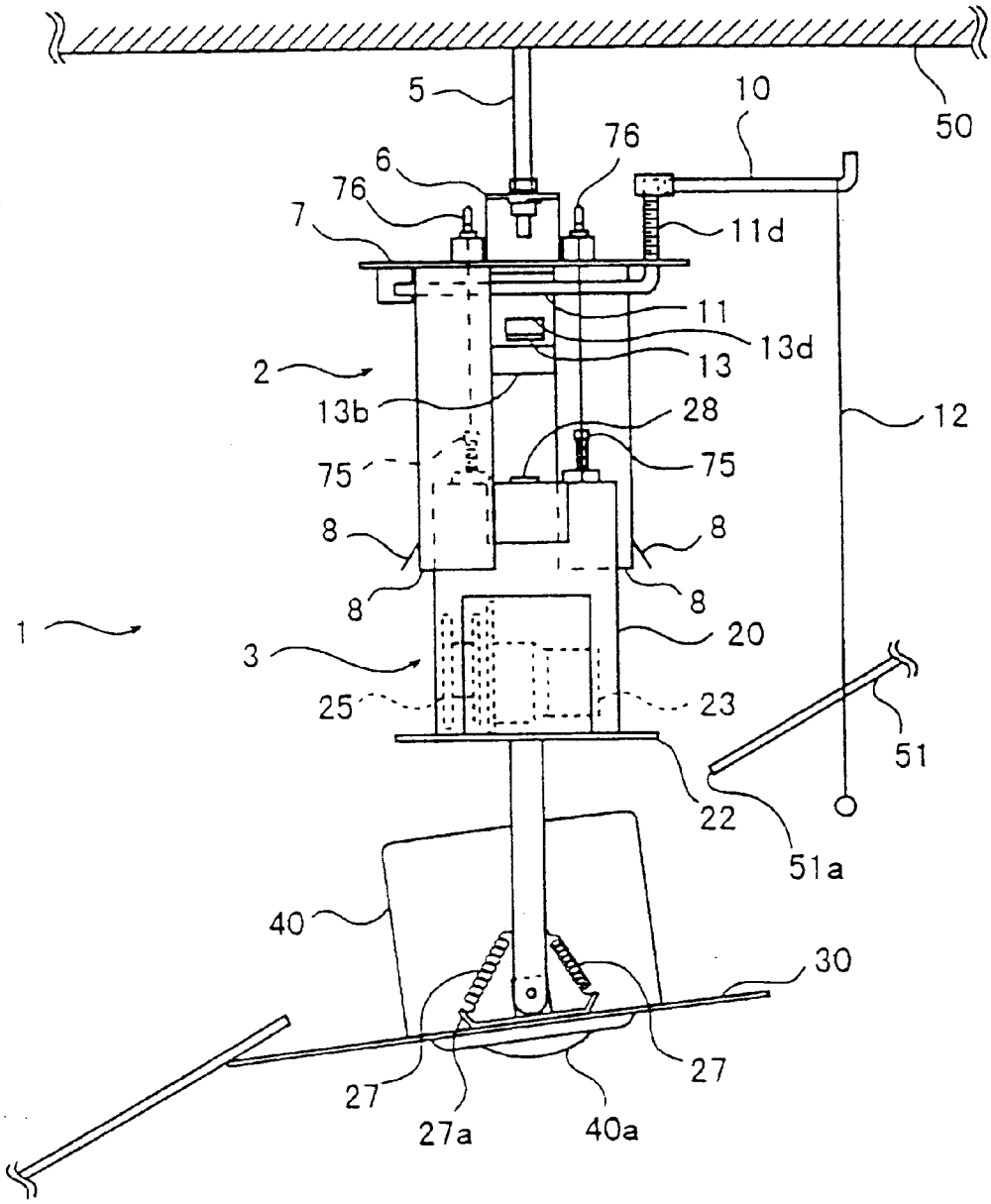
FIG. 2 is a front view of the hanging device shown in the condition that the device body slight approaches the ceiling board.
Figure 3:
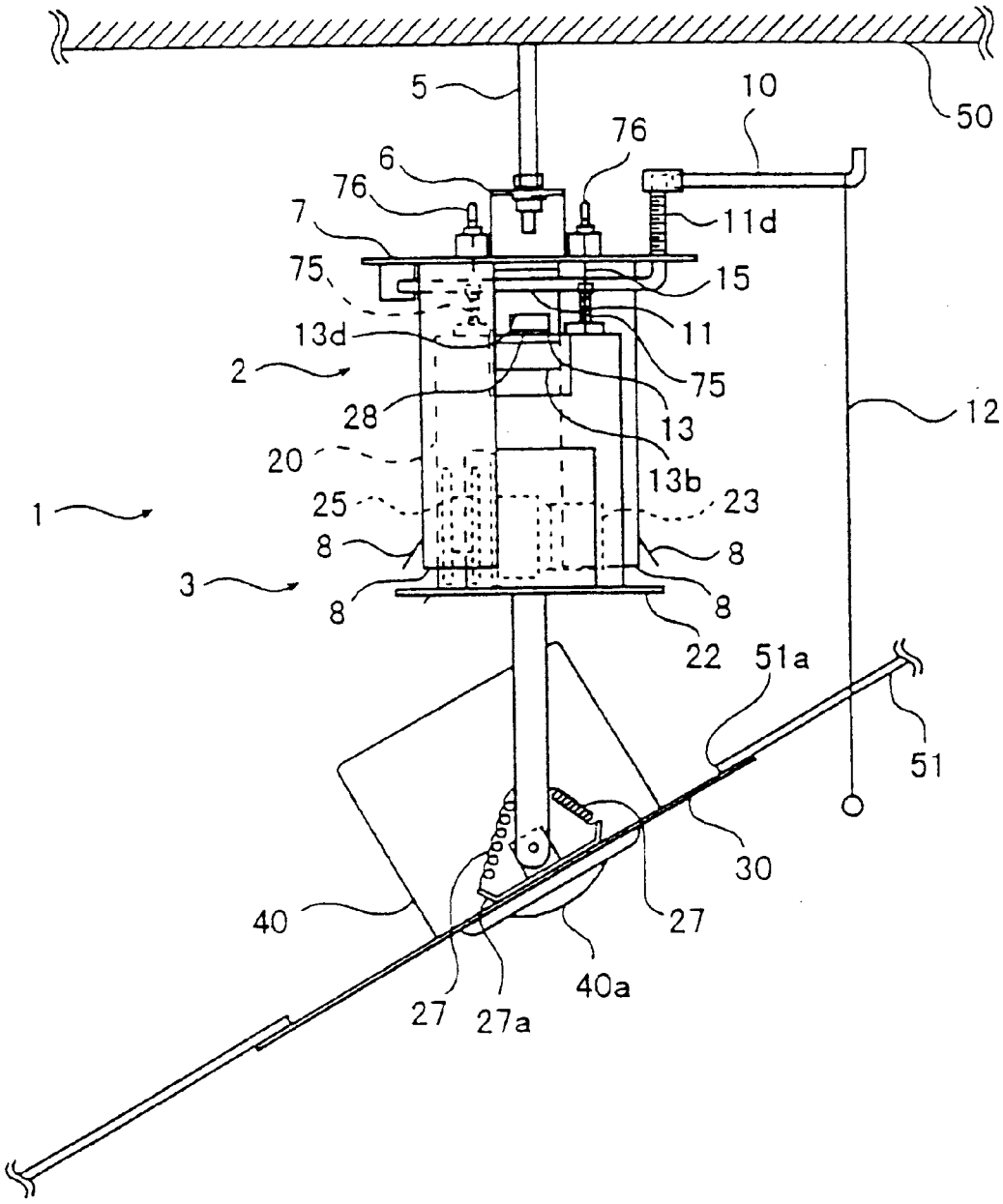
FIG. 3 is a front view of the hanging device shown in the condition that the device body is set up to the ceiling board.
Figure 4:
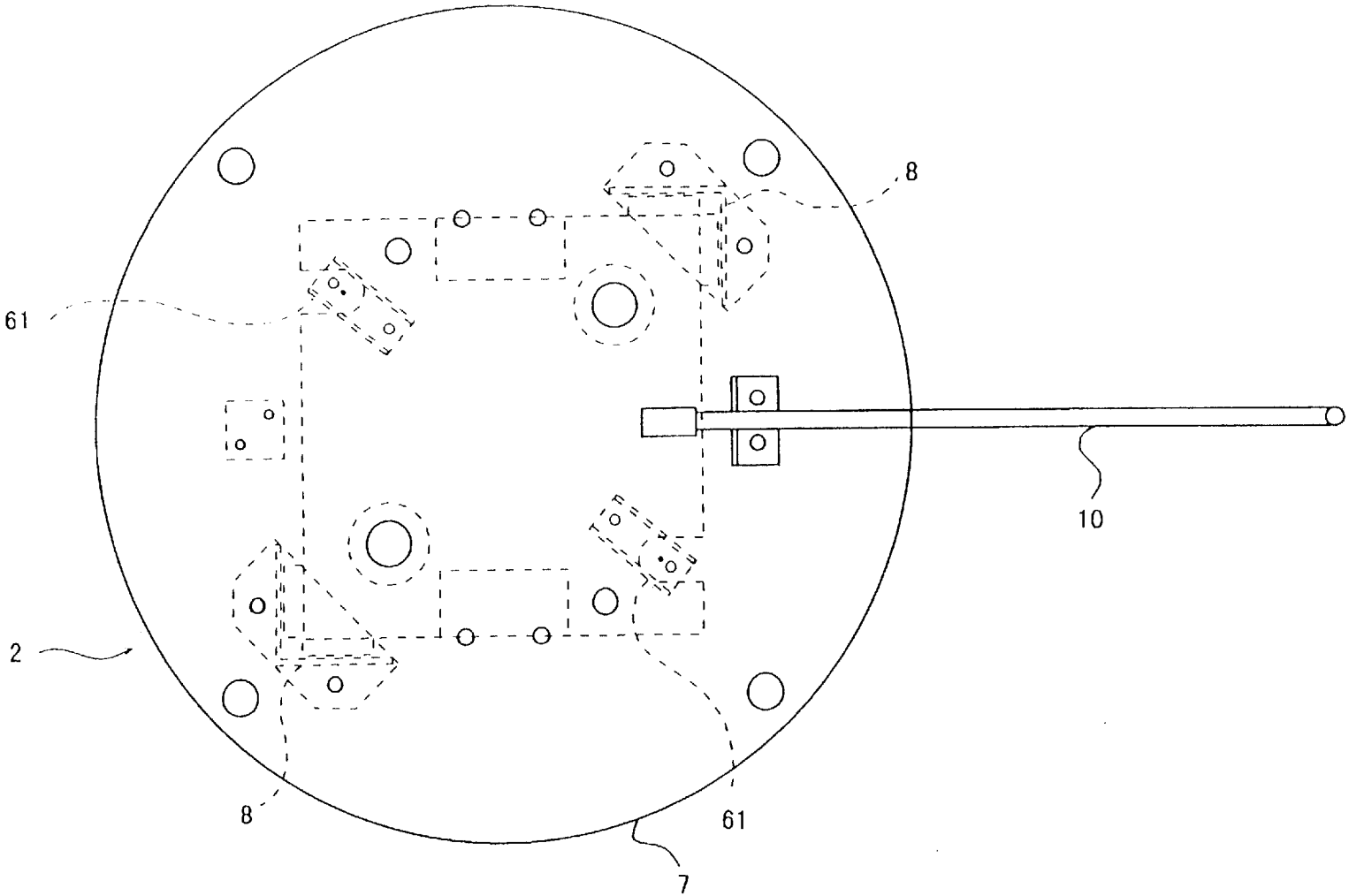
FIG. 4 is a plane view of a base frame shown in FIG. 1.
Figure 5:
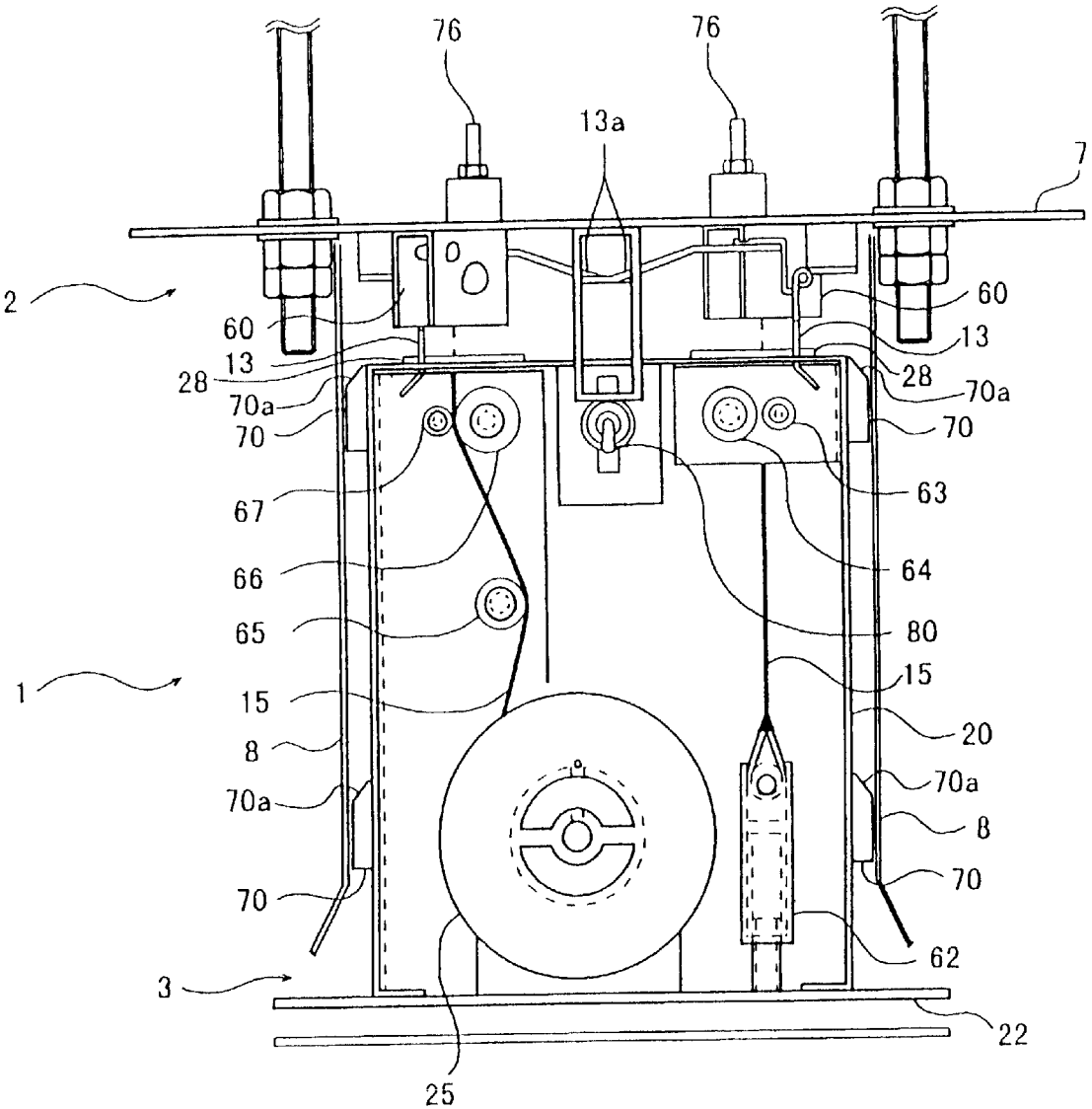
FIG. 5 is a side view of the base frame together with a second frame, means for lifting the second frame, and a means for engaging the second frame to the base frame shown in FIG. 1.
Figure 6:
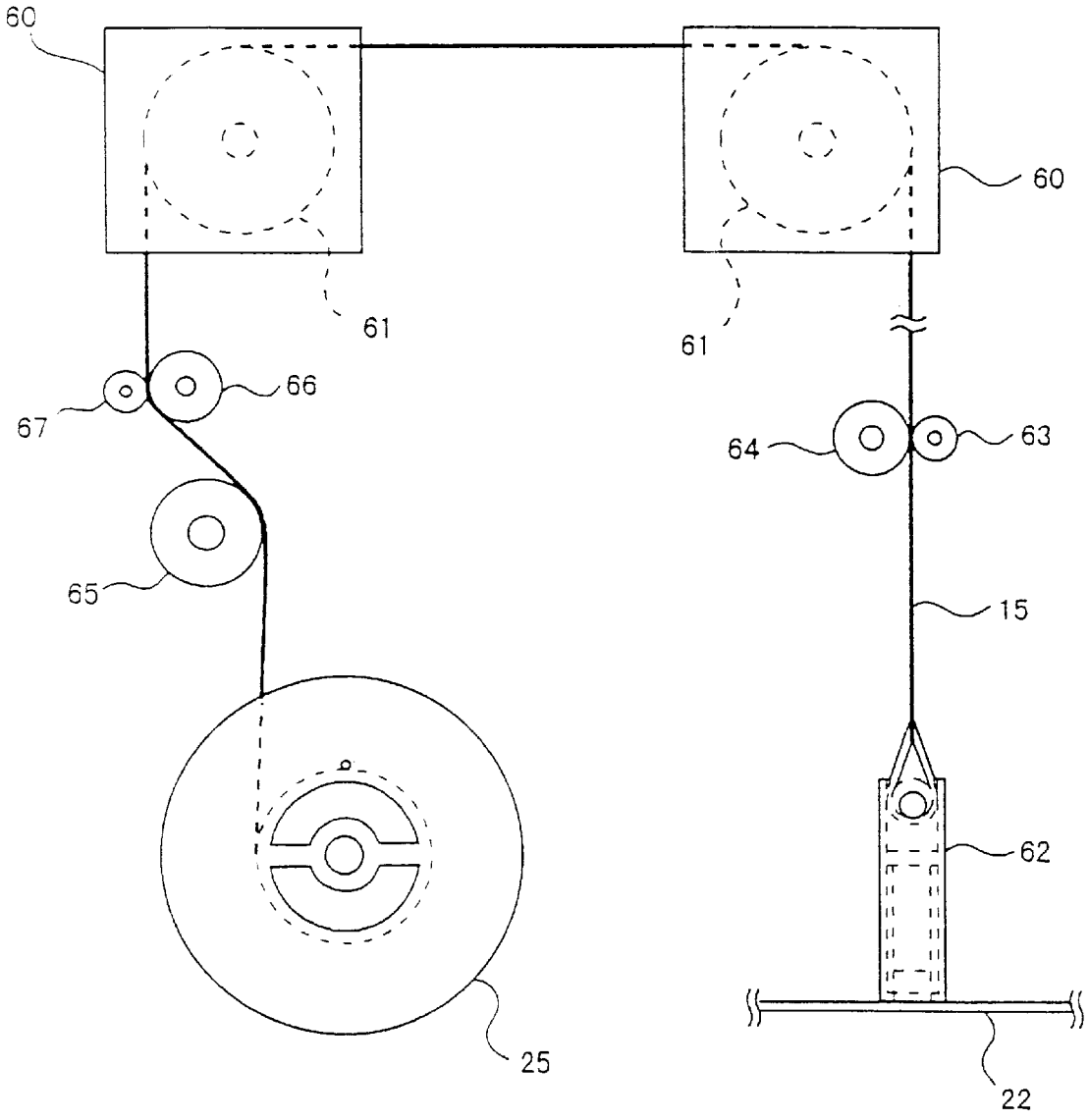
FIG. 6 is a side view of the lifting means.
Figure 7:
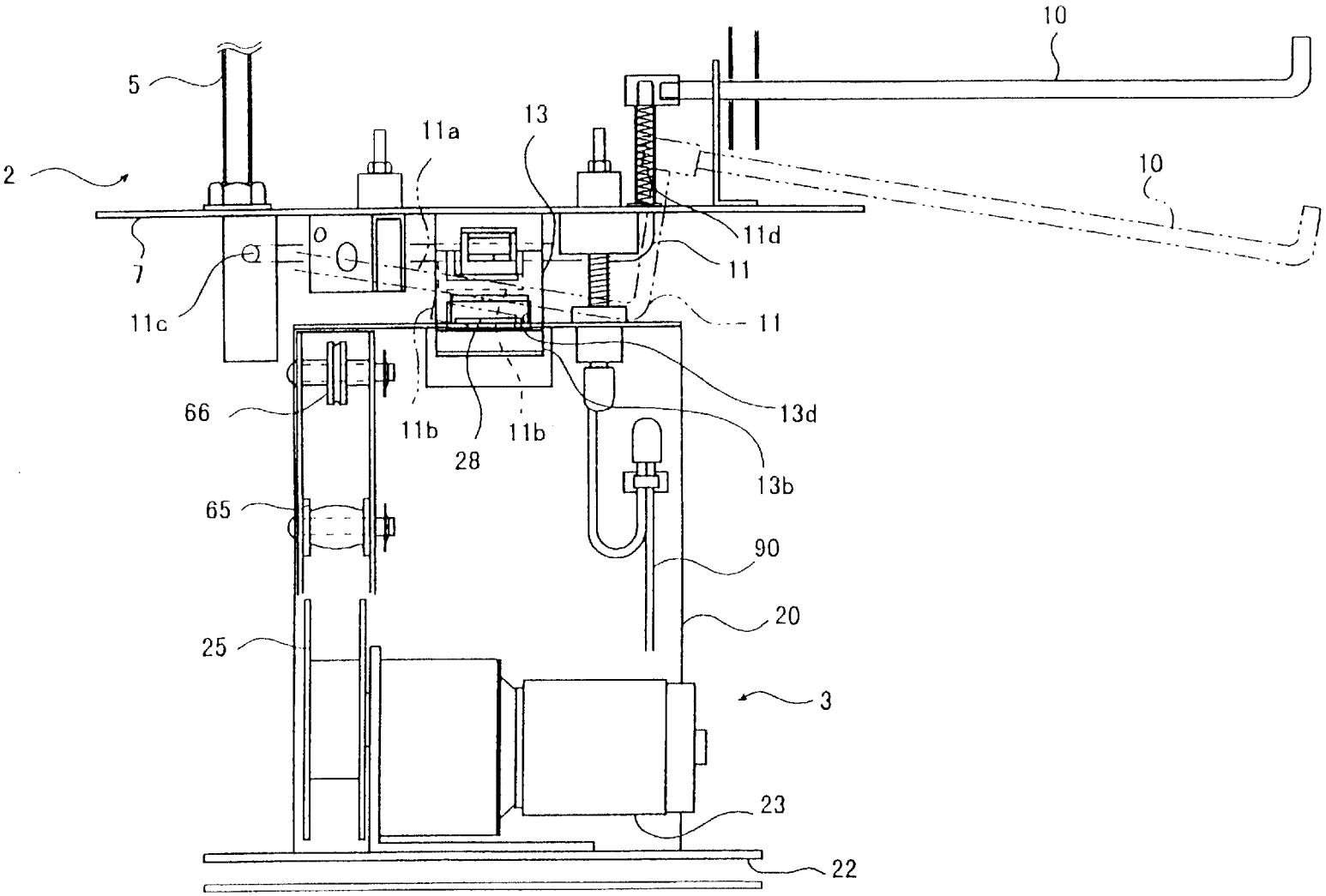
FIG. 7 is a front view of the base frame together with a second frame, means for lifting the second frame, and a means for engaging the second frame to the base frame shown in FIG. 1.
Figure 8:
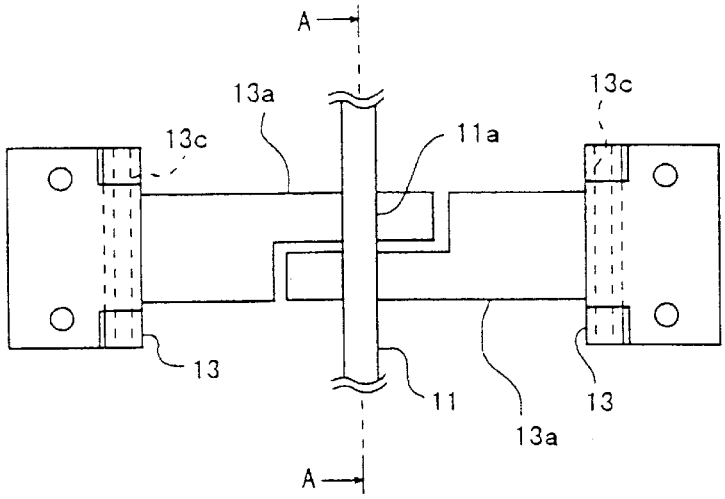
FIG. 8 is a side view of a part of the engaging means shown in FIG. 5.
Figure 9:
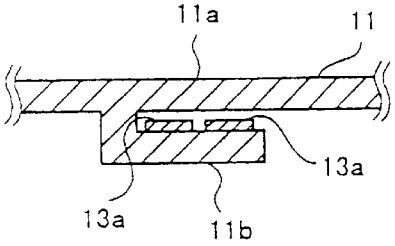
FIG. 9 is a cross-section of the part taken along A—A line in FIG. 8.

At the second stage, the motor 23 drives the winch 25 under the switch 80 being set on, so as to wind the hanging wire 15 as shown in FIG. 1, so as to lift up the second frame 3 together with the device body 40. During the lifting operation, the shell 20 is guided to the under portion of the base frame 2 in a manner to slide the corner leader 70 along the guide member 8 as shown in FIG. 2, and such an operation continues until the second frame 3 is arrived to its upper stage as shown in FIG. 3 so as to pass the device body 40 through the hole 51*a* and contact or fit with the flange 30 to the under surface of the ceiling board 51.

Figure 10:
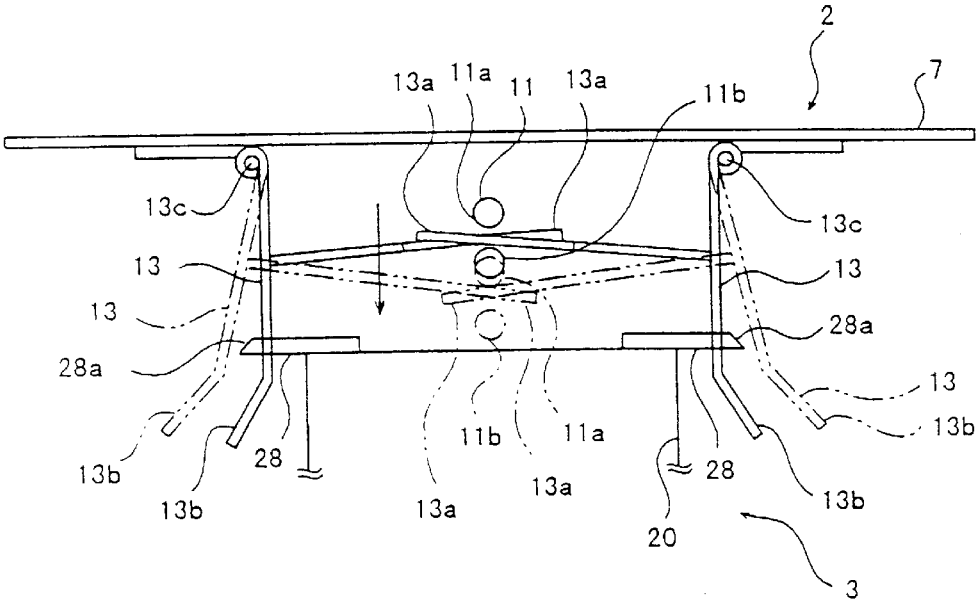
FIG. 10 is a side view of the part of the engaging means shown in such a condition that the second frame is engaged to the frame.
Figure 11:
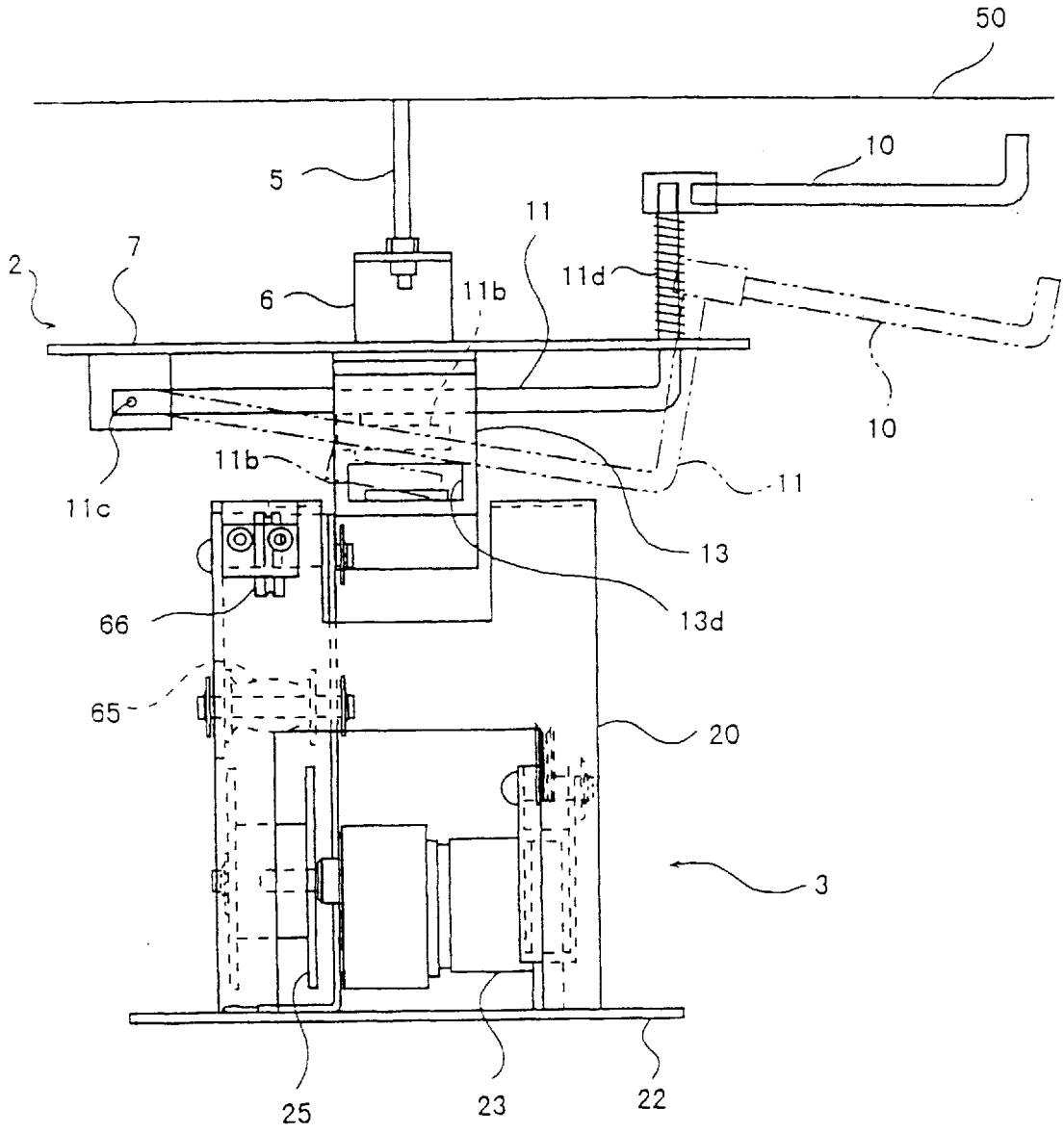
FIG. 11 is a side view of the base frame together with a second frame, a means for lifting the second frame, and a means for engaging the second frame to the base frame shown in FIG. 1.
Figure 12:
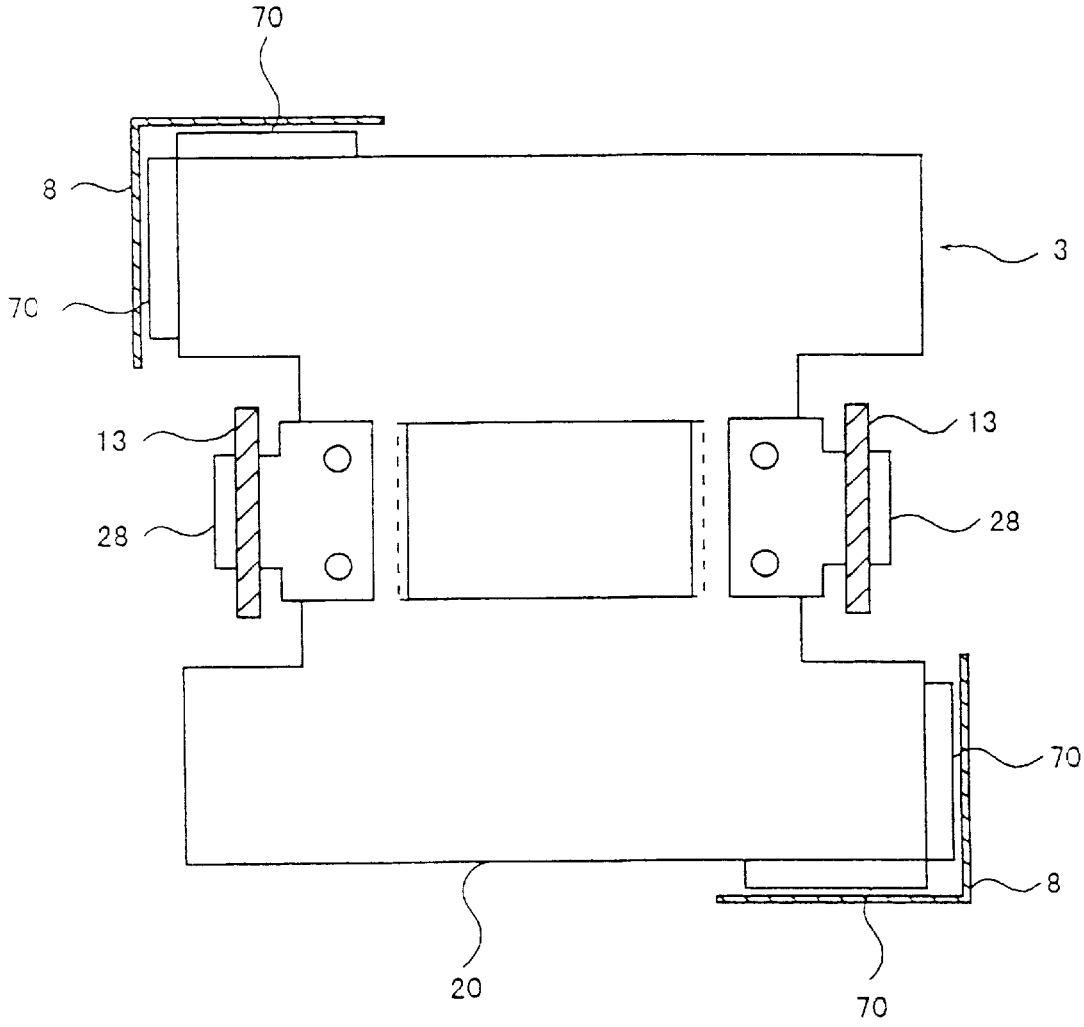
FIG. 12 is a plane view of the second frame.
Figure 13:
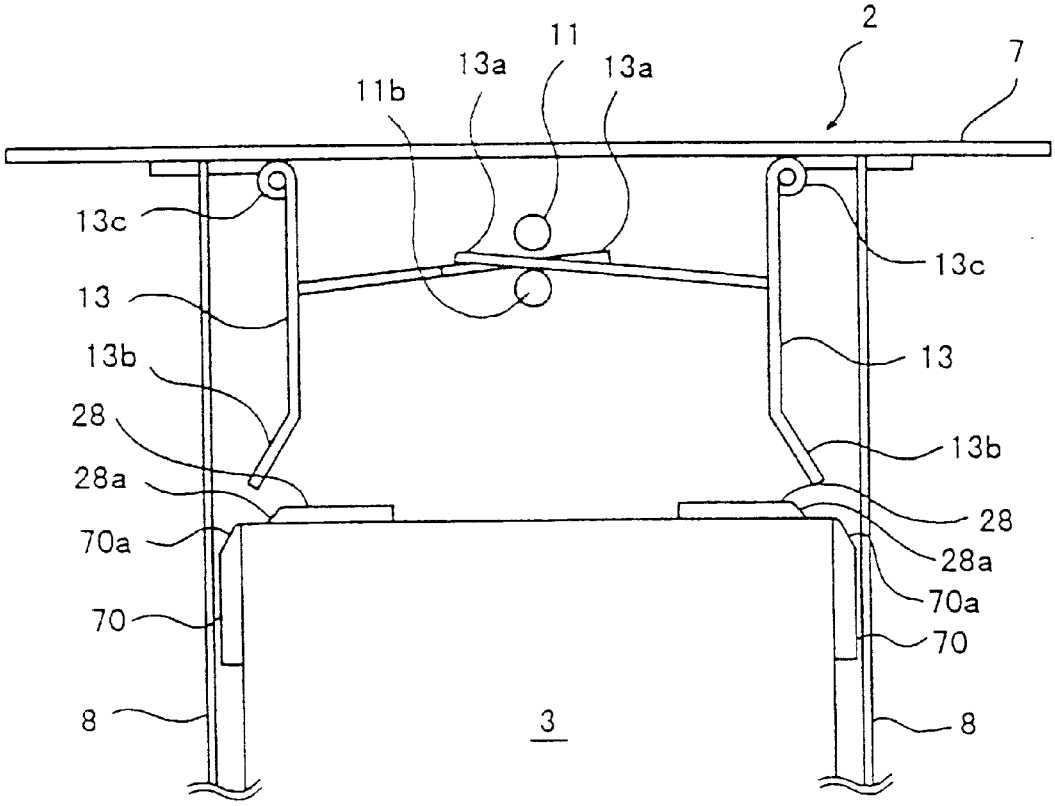
FIG. 13 is a side view of the second frame just before its being engaged to the base frame.
Figure 14:
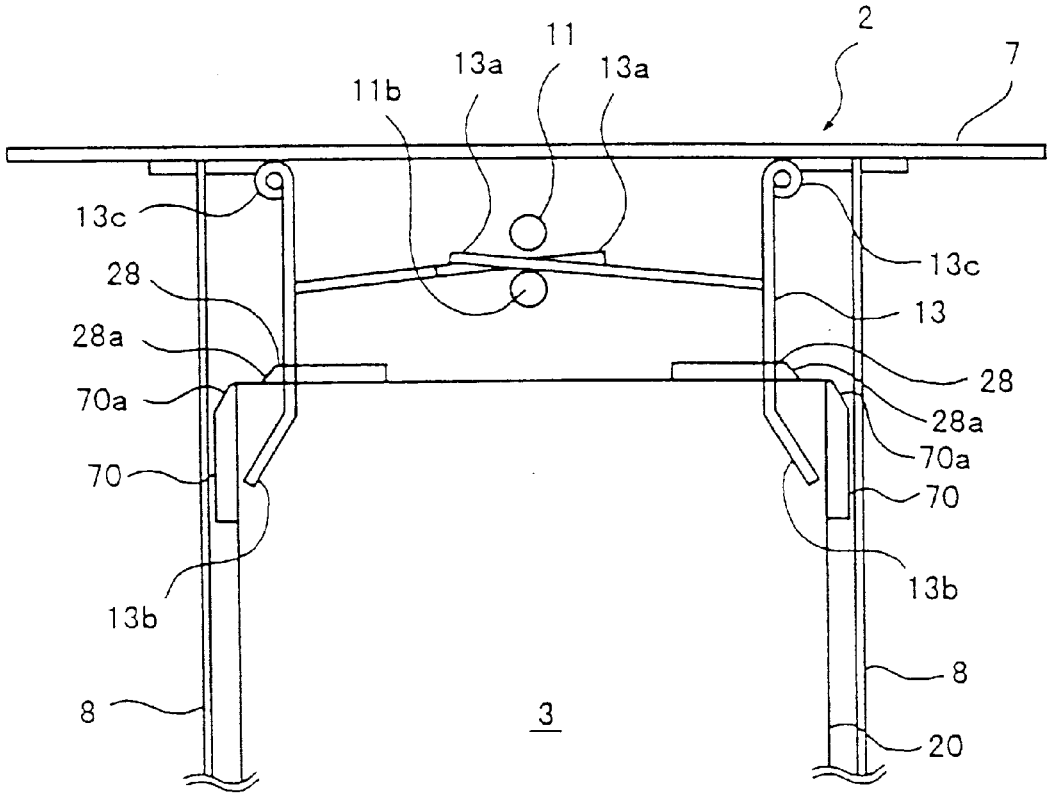
FIG. 14 is a side view of the second frame engaged to the base frame.

Finally, just before the second frame 3 arrives at its upper stage, the hook 28 outwardly pushes the hanger member 13 against the bias of the spring member as shown by dotted lines in FIG. 10 and inserts into the slit 13*d* as shown by solid lines, thereby to engage the second frame 3 to the base frame 2.

Accordingly, the second frame 3 together with the device body 40 is supported by the ceiling beam 50, and the flange 22 is set up to the under surface of the ceiling board 51 in a manner to close the bore 51*a*.

Simultaneously, the limit switch is set off so as not to energize the motor 23, thereby to stop the lifting operation by the hanging wire 15. In this condition, the contact electrodes 75 and 76 are mutually engaged to introduce the electric current from the out source to the device body 40 for illumination.

In order to release the engaging between the first and second frames, the operating rope is pulled down so as to swing down the horizontal extending portion 11*a* together with the arms 13*a* of the hanger members 13.

What is claimed is:

1. A hanging device comprising a base frame to be mounted to a ceiling beam, a second frame to be lifted to the base frame, a base body hung from the second frame, a means for lifting up the second frame together with a device body to the base frame through a hole formed to a ceiling board under the ceiling beam, a flange mounted to the device body so as to fit the ceiling board, and a means for engaging the second frame to the base frame at a position in such that the device body is set up to the ceiling board and simultaneously, the flange fits to the under surface to the ceiling board.

2. A hanging device claimed in claim 1, in which the lifting means includes a winch for winding a hanging wire and a wire stay member for supporting the terminal end of the hanging wire both of which are mounted to the second frame, a plurality of standing pulleys for guiding the hanging wire are mounted to the base frame, and the device body is hung from the second frame through a hanging member so that the gravity center of the device body is disposed to or near the hanging position to the hanging member.

3. A hanging device claimed in claim 2, in which there is provided with a means for biasing the device body in a manner to be maintained in its horizontal condition.

4. A hanging device claimed in claim 2, in which the engaging means includes a pair of hanger members pivoted to the base frame in such an open condition that the second frame can be lifted to an engaging position adapted to the hanger members, a member for operating the hanger members in such a close condition that the second frame is engaged to the hanger members.

5. A hanging device claimed in claim 1, in which the engaging means includes a pair of hanger members pivoted to the base frame in such an open condition that the second frame can be lifted to an engaging position adapted to the hanger members, a member for operating the hanger members in such a close condition that the second frame is engaged to the hanger members.

* * * * *